United States Patent [19]

Miyabe

[11] Patent Number: 4,932,864

[45] Date of Patent: Jun. 12, 1990

[54] ROLLER HEARTH TYPE HEAT TREATING FURNACE

[75] Inventor: Yoshinaga Miyabe, Nishinomiya, Japan

[73] Assignee: Chugai Ro Co., Ltd., Osaka, Japan

[21] Appl. No.: 376,600

[22] Filed: Jul. 7, 1989

[30] Foreign Application Priority Data

Jun. 8, 1988 [JP] Japan ..... 63-91161[U]

[51] Int. Cl.[5] ..... F27B 9/20

[52] U.S. Cl. ..... 432/128; 432/236; 432/237; 432/77

[58] Field of Search ..... 432/77, 81, 233, 236, 432/237, 128, 147, 238

[56] References Cited

U.S. PATENT DOCUMENTS

| | | | |
|---|---|---|---|
| 3,778,221 | 12/1973 | Bloom | 432/128 |
| 4,193,761 | 3/1980 | Mantegani | 432/128 |
| 4,397,451 | 8/1983 | Kinoshita et al. | 432/128 |
| 4,586,898 | 5/1986 | Orbeck | 432/128 |
| 4,596,527 | 6/1986 | Yamada et al. | 432/236 |
| 4,627,814 | 12/1986 | Hattori et al. | 432/128 |
| 4,775,316 | 10/1988 | Zelaschi | 432/128 |

*Primary Examiner*—Henry C. Yuen

*Attorney, Agent, or Firm*—Wenderoth, Lind & Ponack

[57] ABSTRACT

A roller hearth type heat treating furnace has a furnace housing, the inside of which is partitioned into first, second and third treating chambers by a plurality of heat insulating intermediate doors. In order to independently control the temperature inside each treating chamber, the first treating chamber is provided with radiant tubes, the second treating chamber with radiant tubes and a cooler with a fan and the third treating chamber with electro tubes and cooling tubes. The furnace accommodates a series of hearth rollers which can be selectively driven by a plurality of electric motors and a plurality of clutches so that a material located in one chamber may be transported into the adjoining chamber only or successively transported within the furnace.

8 Claims, 2 Drawing Sheets

ROLLER HEARTH TYPE HEAT TREATING FURNACE

BACKGROUND OF THE INVENTION

1. Field of the Invention

The present invention generally relates to a heat treating furnace, and more particularly, to a roller hearth type heat treating furnace.

2. Description of the Prior Art

Conventionally, heat treatments of steel materials can be broadly classified into two, in one of which after the materials have been heated up to a predetermined temperature and soaked at this temperature, they are rapidly cooled down (isothermal annealing, normalizing), and in the other of which they are slowly cooled down (full annealing, spheroidize annealing).

In the former, since the temperature difference between a heating zone and a cooling zone is large, a heat insulating intermediate door is generally provided between these zones to substantially partition them from each other.

In the latter, since the temperature difference between adjacent zones is relatively small, these zones are generally partitioned by a partition wall.

As described above, the structure inside the furnace differs, depending upon the heat treatments of the materials. In particular, it is necessary to partition the heating zone and the cooling zone from each other by any suitable partition structure. Accordingly, a most suitable heat treating furnace in a plurality of furnaces is selectively used for heat-treating the materials.

Accordingly, in the present circumstances having a tendency towards the manufacture of many kinds and small quantity, each of the furnaces is low in operating efficiency. Furthermore, the furnaces are frequently brought into operation or to a stop, resulting in increased heat loss and in increased maintenance or inspection work at the time of recommencement of operation.

SUMMARY OF THE INVENTION

Accordingly, the present invention has been developed with a view to substantially eliminating the above described disadvantages inherent in the prior art roller hearth type heat treating furnace, and has for its essential object to provide an improved roller hearth type heat treating furnace which is capable of independently performing a plurality of heat treatments.

Another important object of the present invention is to provide a roller hearth type heat treating furnace of the above described type which is simple in construction and stable in functioning, and can be readily operated without any difficulty.

In accomplishing these and other objects, a roller hearth type heat treating furnace according to one preferred embodiment of the present invention has a furnace housing, the inside of which is partitioned into first, second and third treating chambers by a plurality of heat insulating intermediate doors. The first treating chamber is provided with heating means while the second and third treating chambers are provided with both heating and cooling means. Accordingly, the inside of each treating chamber can be independently controlled in temperature. The furnace according to the present invention accommodates a series of hearth rollers which can be selectively driven by a plurality of electric motors and a plurality of clutches so that a material located in one chamber may be transported into the adjoining chamber only or successively transported within the furnace.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENTS

Figure 1:
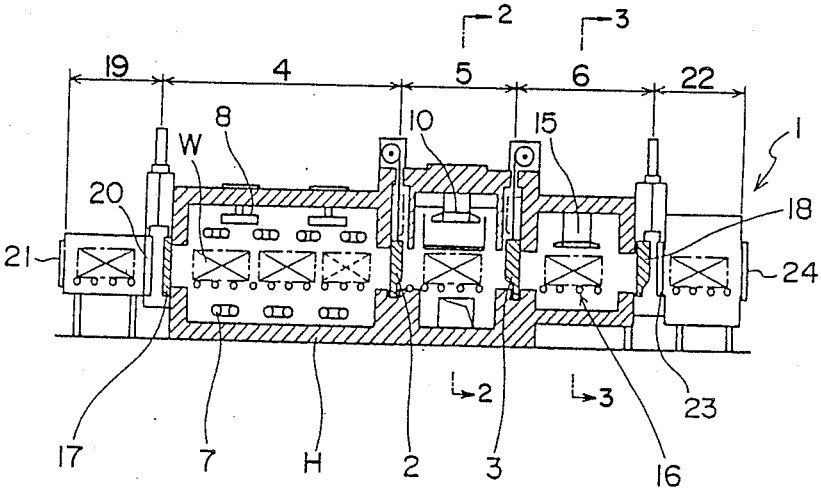
FIG. 1 is a schematic sectional view of a roller hearth type heat treating furnace according to one preferred embodiment of the present invention.
Figure 2:
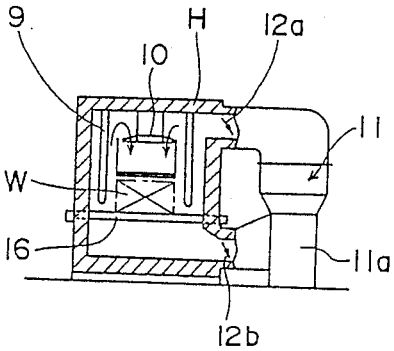
FIG. 2 is a section taken along the line II—II in FIG. 1.
Figure 3:
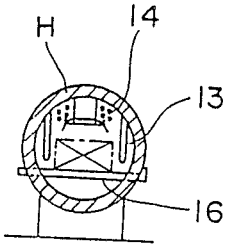
FIG. 3 is a section taken along the line III—III in FIG. 1.

Referring first to FIGS. 1, 2 and 3, a roller hearth type heat treating furnace 1 according to one preferred embodiment of the present invention has a furnace housing H, the inside of which is partitioned by heat insulating intermediate doors 2 and 3 into three: a first treating chamber 4; a second treating chamber 5 and a third treating chamber 6. The first treating chamber 4 is provided with a charge door 17 for opening or closing an opening through which a material is charged into the first treating chamber 4, while the third treating chamber 6 is provided with a discharge door 18 for opening or closing an opening through which the material is discharged from the third treating chamber 6.

The first treating chamber 4 accommodates heating means of a plurality of radiant tubes 7 and a plurality of recirculation fans 8. The second treating chamber 5 accommodates heating means of a plurality of radiant tubes 9 and a recirculation fan 10 and is provided on its side wall with cooling means of a cooler 11 with a fan 11*a* communicating with the inside of the second treating chamber 5 via dampers 12*a* and 12*b*, which are completely closed at the time of heating. The third treating chamber 6 accommodates heating means of a plurality of electro tubes 13, cooling means of a plurality of cooling tubes 14 and a recirculation fan 15.

Accordingly, the inside of each of the chambers 4, 5 and 6 can be independently controlled in temperature by the heating and cooling means.

The furnace 1 of the present invention is further provided with a charge vestibule 19 adjoining the first treating chamber 4 and a discharge vestibule 22 adjoining the third treating chamber 6. The charge and discharge vestibules 19 and 22 are provided with respective front and rear doors 21, 20 and 23, 24.

A series of hearth rollers 16 are rotatably disposed inside the furnace 1 to transport the material downwards.

Figure 4:
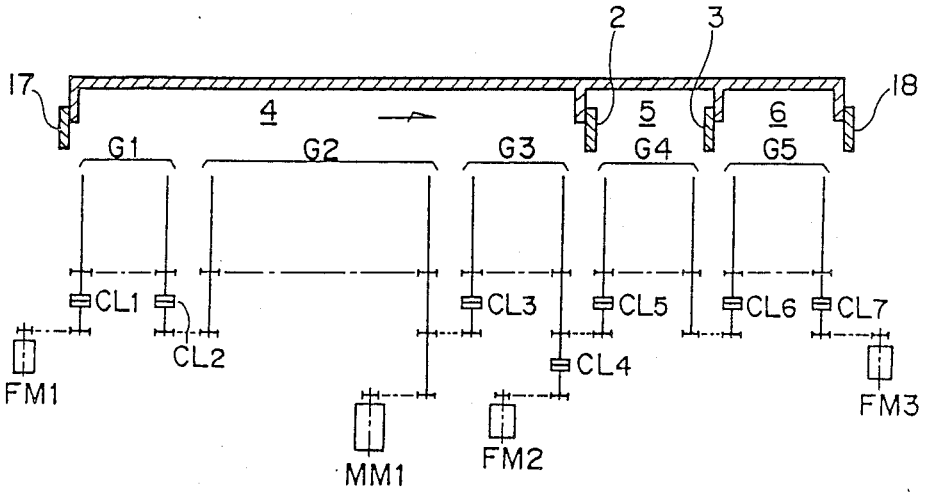
FIG. 4 is a schematic view indicative of an operation mechanism.

FIG. 4 schematically depicts a mechanism for operating the hearth rollers 16 disposed inside the furnace housing H.

In the operation mechanism of FIG. 4, all the hearth rollers 16 in the furnace housing H are grouped into five: three groups G1, G2 and G3 in the first treating chamber 4; one group G4 in the second treating chamber 5 and one group G5 in the third treating chamber 6. The hearth rollers 16 in each group can be arbitrarily driven by selectively engaging or disengaging clutches CL1 to CL7 and by selectively driving a steady feed electric motor MM1 and high speed feed electric motors FM1 to FM3.

The roller hearth type heat treating furnace 1 having the above described construction is operated as follows.

Heat Treatment Requiring Slow Cooling (Full Annealing, Spherodize Annealing)

Figure 5:
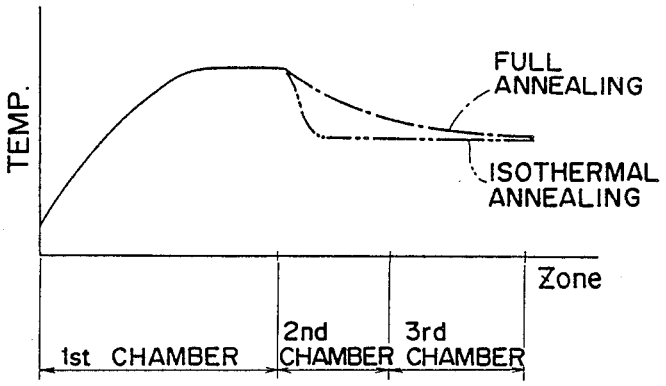
FIG. 5 is a heat curve indicative of the temperature of a material within the furnace.

The heat insulating intermediate doors 2 and 3 are opened and the heating and cooling means in the treating chambers 4, 5 and 6 are brought into operation so that the temperature inside the chambers 4, 5 and 6 may be set as shown by a single dotted line in a heat curve of FIG. 5.

Thereafter, the motor MM1 is operated on condition that the clutches CL2, CL3 CL5 and CL6 are engaged whereas the clutches CL1, CL4 and CL7 are disengaged. In other words, all the hearth rollers 16 in the furnace 1 are rotated in the same speed so that a material W may be successively transported.

When the material W in the charge vestibule 19 is charged into the first treating chamber 4 at a high speed, the hearth rollers 16 in the group G1 are rotated at the high speed by engaging the clutch CL1 and disengaging the clutch CL2 and by operating the motor FM1. On the other hand, when the material W is located in the third treating chamber 6 and discharged into the discharge vestibule 22 at a high speed, the hearth rollers 16 in the group G5 are rotated at the high speed by engaging the clutch CL7 and disengaging the clutch CL6 and by operating the motor FM3. In each of the above two cases, when the material W is charged or discharged, the engagement of the clutches and the motors are restored to their prior conditions.

Heat Treatment Requiring Rapid Cooling (Isothermal Annealing, Normalizing)

The heat insulating intermediate doors 2 and 3 are closed and the heating and cooling means in the chambers 4, 5 and 6 are brought into operation so that the temperature inside the chambers 4, 5 and 6 may be set as shown by a double dotted line in the heat curve of FIG. 5. In this case, the second treating chamber 5 acts as a rapid cooling zone. Accordingly, the temperature inside this chamber 5 i.e. the atmosphere temperature is regulated by controlling the opening of the dampers 12*a* and 12*b* or by the on-off control or the speed control of the cooler fan 11*a*.

The material W in the first treating chamber 4 can be transported by engaging only the clutches CL2 and CL3 and by driving the motor MM1. When the material W has reached an end of the first treating chamber 4, the heat insulating intermediate door 2 is opened. Thereafter, the material W can be transported into the second treating chamber 5 at the high speed by disengaging the clutch CL3 and engaging the clutches CL4 and CL5 and by driving the motor FM2.

Furthermore, after the heat insulating intermediate door 3 has been opened, the material W in the second treating chamber 5 can be transported into the third treating chamber 6 at the high speed by engaging the clutches CL6 and CL7 and by driving the motor FM3. Then, the discharge door 18 is opened before this material W is discharged into the discharge vestibule 22 by engaging the clutch CL7 and by driving the motor FM3.

Upon completion of the charge or discharge of the material, the engagement of the clutches and the motors are restored to their prior conditions.

The foregoing embodiment employs the radiant and electro tubes as the heating means and the cooler and the cooling tubes as the cooling means because protective atmosphere gas is supplied into the furnace. However, the heating or cooling means is not limited by this embodiment. For example, in the case of a direct firing type furnace, the furnace housing may be provided as the cooling means with a pipe or pipes with control dampers through which outside air is introduced into the furnace.

As is clear from the above, according to the roller hearth type heat treating furnace of the present invention, the inside of the furnace housing is partitioned into the first, second and third treating chambers by the heat insulating intermediate doors. The first treating chamber is provided with the heating means while the second and third treating chambers are provided with both the heating and cooling means. Drive conditions of the hearth rollers can be switched so that a material located in one chamber may be transported into the adjoining chamber only or may be successively transported within the furnace. Furthermore, it is capable of independently controlling the temperature inside the treating chambers. Accordingly, not only the fashion of transportation can be selectively determined but the setting temperature inside each chamber can be changed in compliance with objects of treatment of materials.

A single roller hearth type heat treating furnace according to the present invention is of service to various kinds of heat treatments such as, for example, the heat treatment requiring rapid cooling, that requiring slow cooling and the like.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A roller hearth type heat treating furnace comprising:

a furnace housing;

at least two intermediate doors for partitioning an inside of said housing into first, second and third treating chambers;

a first heating means disposed inside said first treating chamber;

a second heating means disposed inside said second treating chamber;

a first cooling means mounted on said second treating chamber;

a third heating means disposed inside said third treating chamber;

a second cooling means disposed inside said third treating chamber;

a series of hearth rollers rotatably disposed inside said housing; and drive means for selectively driving said hearth rollers so that a material located in one chamber can be transported into an adjoining chamber only or can be successively transported within said housing;

each of said first, second and third treating chambers being independently controlled in temperature.

2. The furnace according to claim 1, wherein said first heating means comprises a plurality of radiant tubes.

3. The furnace according to claim 1, wherein said second heating means comprises a plurality of radiant tubes.

4. The furnace according to claim 1, wherein said first cooling means comprises a cooler with a fan mounted on a side wall of said second treating chamber.

5. The furnace according to claim 1, wherein said third heating means comprises a plurality of electro tubes.

6. The furnace according to claim 1, wherein said second cooling means comprises a plurality of cooling tubes.

7. The furnace according to claim 1, wherein said drive means comprises a plurality of electric motors and a plurality of clutches.

8. The furnace according to claim 7, wherein said hearth rollers are grouped into a plurality of groups so that each group is coupled with one of said motors.

* * * * *